US009818497B2

(12) United States Patent
Comoret et al.

(10) Patent No.: US 9,818,497 B2
(45) Date of Patent: Nov. 14, 2017

(54) METHOD OF MANUFACTURING AN ELONGATED ELECTRICALLY CONDUCTING ELEMENT

(71) Applicant: NEXANS, Paris (FR)

(72) Inventors: Emilien Comoret, Hornaing (FR); Christian-Eric Bruzek, Thun St Martin (FR)

(73) Assignee: NEXANS, Paris (FR)

( * ) Notice: Subject to any disclaimer, the term of this patent is extended or adjusted under 35 U.S.C. 154(b) by 571 days.

(21) Appl. No.: 14/297,760

(22) Filed: Jun. 6, 2014

(65) Prior Publication Data

US 2014/0367145 A1 Dec. 18, 2014

(30) Foreign Application Priority Data

Jun. 17, 2013 (FR) ..... 13 55615

(51) Int. Cl.

| | |
|---|---|
| ***H01B 1/02*** | (2006.01) |
| ***B22F 3/00*** | (2006.01) |
| ***H01B 1/04*** | (2006.01) |
| ***B22F 7/08*** | (2006.01) |
| ***C22C 47/14*** | (2006.01) |
| ***C22C 49/06*** | (2006.01) |
| ***C22C 49/14*** | (2006.01) |
| ***B22F 3/105*** | (2006.01) |
| ***C22C 26/00*** | (2006.01) |
| *C22C 1/04* | (2006.01) |

(52) U.S. Cl.

CPC ..... *H01B 1/04* (2013.01); *B22F 3/105* (2013.01); *B22F 7/08* (2013.01); *C22C 26/00* (2013.01); *C22C 47/14* (2013.01); *C22C 49/06* (2013.01); *C22C 49/14* (2013.01); *H01B 1/02* (2013.01); *B22F 2998/10* (2013.01); *C22C 1/0416* (2013.01); *C22C 1/0425* (2013.01); *C22C 1/0466* (2013.01); *C22C 2026/002* (2013.01)

(58) Field of Classification Search

CPC ... H01B 1/00; H01B 1/02; H01B 1/06; H01B 1/24; B22F 1/0085; B22F 3/12; B22F 3/1258; B22F 3/164; B22F 3/20; B22F 3/248

See application file for complete search history.

(56) References Cited

U.S. PATENT DOCUMENTS

| | | | | |
|---|---|---|---|---|
| 2005/0087726 | A1* | 4/2005 | Anazawa | B82Y 30/00 252/500 |
| 2011/0003174 | A1 | 1/2011 | Hikata et al. | |
| 2011/0247866 | A1 | 10/2011 | Kim et al. | |
| 2012/0175547 | A1* | 7/2012 | Adams | B82Y 30/00 252/71 |
| 2012/0263951 | A1 | 10/2012 | Mueller et al. | |
| 2013/0323494 | A1 | 12/2013 | Ueno et al. | |
| 2016/0057544 | A1* | 2/2016 | Chamarthy | H04R 9/046 381/410 |

FOREIGN PATENT DOCUMENTS

| | | |
|---|---|---|
| CA | 2423215 | 9/2004 |
| DE | 20315006 | 2/2004 |
| JP | 2007280731 | 10/2007 |
| WO | 2008051302 | 5/2008 |
| WO | 2011036387 | 3/2011 |
| WO | 2012145267 | 10/2012 |

OTHER PUBLICATIONS

Kuzumaki et al "Processing of carbon nanotube reinforced aluminum composites", Journal of Materials Research, vol. 13, No. 9, (1998) pp. 2445-2449.*

Quang et al "Consolidation of 1 vol% carbon nanotube reinforced metal matrix . . . ", Journal of Materials Processing Technology, 187-188 (2007) 318-320.*

International Search Report dated 2014.

* cited by examiner

*Primary Examiner* — Mark Kopec

(74) *Attorney, Agent, or Firm* — Sofer & Haroun, LLP

(57) ABSTRACT

A method of manufacturing an elongated electrically conducting element having functionalized carbon nanotubes and at least one metal, includes the steps of mixing functionalized carbon nanotubes with at least one metal, to obtain a composite mixture, and forming a solid mass from the composite mixture from step (i). A solid element obtained from the solid mass from step (ii) is inserted into a metal tube, and the metal tube from step (iii) is deformed, to obtain an elongated electrically conducting element.

15 Claims, No Drawings

METHOD OF MANUFACTURING AN ELONGATED ELECTRICALLY CONDUCTING ELEMENT

RELATED APPLICATION

This application claims the benefit of priority from French Patent Application No. 13 55615, filed on Jun. 17, 2013, the entirety of which is incorporated by reference.

BACKGROUND

Field of the Invention

The present invention relates to a method of manufacturing a conductor comprising functionalized carbon nanotubes and at least one metal, to an elongated electrically conducting element obtained by carrying out said method and to an electric cable comprising a conducting element of this kind.

It applies typically, but not exclusively, to low-voltage (notably below 6 kV) or medium-voltage (notably from 6 to 45-60 kV) or high-voltage (notably above 60 kV, and which may be up to 800 kV) power cables, whether direct-current or alternating-current, in the fields of overhead, submarine or terrestrial electricity transmission and in aeronautics.

More particularly, the invention relates to an electric cable having good mechanical properties and good electrical, conductivity.

Description of Related Art

A method is known from document FR 2 950 333 A1 comprising a step of functionalization of carbon nanotubes to obtain functionalized carbon nanotubes, and a step of bringing said functionalized carbon nanotubes into contact with metal particles so form a composite material, and said composite material, can be used for manufacturing electric cables. The step of functionalization of the carbon nanotubes according to this method makes it possible to obtain carbon nanotubes that have particular chemical groups, such as enol functions, on the surface. However, this method does not describe the steps allowing an electric cable to be manufactured starting from said composite material, and consequently is unable to provide an electric cable having good mechanical and electrical properties.

OBJECTS AND SUMMARY

The aim of the present invention is to overcome the drawbacks of the techniques of the prior art by proposing a method of manufacturing an electrical conductor comprising functionalized carbon nanotubes and at least one metal, said method being easy to apply and able to guarantee and maintain good transfer of mechanical and electrical load between the metal and the carbon nanotubes and thus obtain a conductor with good mechanical and electrical properties.

The present invention relates to a method of manufacturing an elongated electrically conducting element comprising functionalized carbon nanotubes and at least one metal, comprising the following step:

i) mixing functionalized carbon nanotubes with at least one metal, to obtain a composite mixture, said method being characterized in that it further comprises the following steps:

ii) forming a solid mass from the composite mixture from step i), iii) inserting a solid element obtained from the solid mass from step ii) into a metal tube iv) deforming said metal tube from step iii), to obtain an elongated electrically conducting element.

Owing to the method of the invention, an elongated electrically conducting element comprising functionalized carbon nanotubes and at least one metal can thus easily be formed, while having good mechanical properties and good electrical conductivity.

Carbon nanotubes are notably an allotropic form of carbon belonging to the class of fullerenes.

More particularly, carbon nanotubes are graphene sheets rolled up and closed at their end by hemispheres similar to fullerenes. In the present invention, the carbon nanotubes also comprise both single-walled carbon nanotubes (SWNTs) comprising a single graphene sheet and multi-walled carbon nanotubes (MWNTs) comprising several graphene sheets stacked inside one another in the manner of Russian dolls, or else a single graphene sheet rolled up on itself several times.

"Functionalized" carbon nanotubes are carbon nanotubes that have chemical groups on their surface. Said chemical groups can represent sites of attachment between the carbon nanotubes, and/or between the metal and the carbon nanotubes while step i) is carried out.

These chemical groups can be selected from $SO_3H$, COOH, $PO_3H_2$, OOH, OH, CHO, CM, COCl, X, COSH, SH, R'CHOH, NHR', COOR', SR', CONHR', OR', $NHCO_2R'$ and R", where X is a halogen, R' is selected from hydrogen, alkyl, aryl, aryl-SH, cycloalkyl, aralkyl, cycloaryl and poly(alkyl ether) and R" is selected from fluoroalkyl, fluoroaryl, fluorocycloalkyl and fluoroaralkyl. The carbon nanotubes are thus functionalized by the direct incorporation of these chemical groups on the surface. This modification represents a covalent surface modification.

DETAILED DESCRIPTION

According to a first variant, commercial grades of functionalized carbon nanotubes can be used directly while step i) of the method according to the invention is carried out.

According to a second variant, the method according to the invention further comprises, prior to step i), the following step:

a) functionalizing of carbon nanotubes.

Step a)

This preliminary step a) makes it possible to obtain functionalized carbon nanotubes that will be used in step i). The methods for functionalization of carbon nanotubes are well known by a person skilled in the art. We may mention, as an example, surface oxidation of the carbon nanotubes, which is currently one of the most used methods for functionalizing said carbon nanotubes. In particular, said surface oxidation can be carried out by dissolving unfunctionalized carbon nanotubes, dispersing them by ultrasound in a solvent, such as a lower alcohol (i.e. an alcohol having from 1 to 5 carbon atoms), and adding an oxidizing agent such as nitric acid/sulfuric acid mixture or hydrogen peroxide to the dispersion. This results in functionalized carbon nanotubes having oxygen-containing chemical groups on the surface such as diketone, ether, carboxylic acid, ester, hydroxyl, and enol groups, etc.

Functionalization of the carbon nanotubes advantageously improves the dispersion of the carbon nanotubes in the composite mixture and consequently promotes transfer of mechanical and electrical load between the carbon nanotubes, and between the metal and the carbon nanotubes.

In fact, the carbon nanotubes as such (i.e. unfunctionalized carbon nanotubes), although having excellent electrical, thermal and mechanical properties, are difficult to disperse in the composite mixture. Entanglement of the carbon nanotubes into balls, combined with low surface reactivity, prevents their dispersion. It is therefore advantageous to have carbon nanotubes whose surface is modified covalently.

Step i)

In a particular embodiment, the amount of functionalized carbon nanotubes in the composite mixture from step i) of the method according to the invention can range from about 0.3 to 15 wt % and preferably from about 5 to 10%.

Above 15 wt % of carbon nanotubes in the composite mixture, a decrease in the degree of densification of the solid mass obtained in step ii) is observed, connected with excessive agglomeration of the functionalized carbon nanotubes in the composite mixture, causing formation of pores in said solid mass and thus degradation of its electrical and mechanical properties.

In a particular embodiment, the metal used in step i) can be selected from copper, aluminum, silver, a copper alloy, an aluminum alloy, a silver alloy and a mixture thereof.

According to a first variant, the mixing according to step i) is carried out by a solid route.

In a particular embodiment, said mixing by a solid route is carried out by mechanical mixing of the functionalized carbon nanotubes with at least one metal, said functionalized carbon nanotubes and said metal being in the form of powders.

In a particular embodiment, said mechanical mixing can be carried out at room temperature, and preferably under a nonoxidizing atmosphere.

Said mechanical mixing of the functionalized carbon nanotubes with at least one metal is a method of mixing the powders that is easy to apply, and can be carried out notably using means such as a planetary mixer, ultrasonic apparatus, or a mixer with steel or ceramic balls, and said means can be used alone or in combination.

According to a second variant, the mixing according to step i) is carried out by a liquid route, i.e. by dissolving the functionalized carbon nanotubes and at least one metal. Said mixing by a liquid route can notably be carried out by applying ultrasound to the dissolved functionalized carbon nanotubes and at least one metal.

When said mixing in step i) is carried out by application of ultrasound, it is preferably carried out according to the following substeps:

1a) dissolving the functionalized carbon nanotubes, and dispersing them by ultrasound, notably for at least 1 hour, in a solvent such as a lower alcohol, to form a homogeneous suspension, 2a) adding at least one metal salt to the homogeneous suspension as obtained in step 1a), and applying ultrasound, notably for 1 to 3 hours, 3a) evaporating the solvent, notably at a temperature that can range from about 100° C. to 250° C., preferably in air, to obtain a powder, 4a) calcining the powder obtained in step 3a), notably at a temperature that can range from about 250° C. to 500° C., to obtain a calcined powder, 5a) reducing the calcined powder obtained in step 4a), notably under hydrogen.

This method is particularly suitable in the case when the functionalized carbon nanotubes from step 1a) have been previously functionalized according to step a) by surface oxidation.

This method of mixing allows the functionalized carbon nanotubes to be incorporated directly between the metal particles and not simply deposited on the surface of the metal particles.

When this mixing step i) is carried out by a solid route or by a liquid route (first and second variants), the agglomerates of functionalized carbon nanotubes break up and can thus be distributed homogeneously in the composite mixture.

In a particular embodiment of these first and second variants, the metal used in step i) comprises metal particles having an average particle diameter in the range from 10 nm to 50 μm, and preferably from 10 nm to 50 nm.

According to a third variant, the mixing according to step i) is carried out by a molten route, i.e. by mixing functionalized carbon nanotubes with at least one molten metal. Said mixing by a molten route can preferably be carried out according to the following substeps:

1b) heating the metal to a temperature above its melting point, so as to form a liquid solution of molten metal, 2b) pouring the liquid solution of molten metal as obtained in step 1b) into the functionalized carbon nanotubes or introducing the functionalized carbon nanotubes into the liquid solution of molten metal as obtained in step 1b), and 3b) mixing the functionalized carbon nanotubes with the liquid solution of molten metal as obtained in step 2b).

According to this third variant, the mixing in step 3b) can be carried out by techniques well known by a person skilled in the art such as mechanical mixing, magnetic mixing or the use of an electromagnetic current.

In a particular embodiment of this third variant, the metal used in step i) is in block form.

In a particular embodiment of the invention, the functionalized carbon nanotubes used in step i) have an average diameter in the range from 1 nm to 50 nm.

Step ii)

Step ii) makes it possible to densify the composite mixture from step i), and thus obtain a solid mass, notably of the monobloc type such as for example a massive bar.

In a particular embodiment, step ii) can be carried out by sintering, i.e. by consolidation by the action of heat.

Overall, there are two sintering techniques: conventional sintering and flash sintering. Step ii) is preferably carried out by flash sintering.

The major difference between conventional sintering and flash sintering is the fact that the heat source is not external but instead an electric current (DC, pulsed DC or AC), applied via electrodes, passes through the conductive pressing enclosure as well as, where appropriate, through the sample. It is this electric current that will heat the sample, directly within it. In general, flash sintering makes it possible to consolidate materials in much shorter time and with a density often far better than conventional sintering.

In a particular embodiment, step ii) is carried out by flash sintering at a pressure that can range from about 10 to 100 bar and/or at a temperature that can range from about 400 to 900° C. In the case when the metal used is aluminum, it is preferable to apply a temperature that can range from about 400 to 550° C. and in the case when the metal used is copper, it is preferable to apply a temperature that can range from about 700 to 900° C. The time for flash sintering can preferably range from about several seconds to several hours.

When step ii) is carried out by flash sintering, it is easier to control, the diffusion of the functionalized carbon nanotubes in the composite mixture, and the risk of degradation of the carbon nanotubes/metal interfaces is avoided.

Formation of a solid mass by flash sintering makes it possible to obtain a composite material with a degree of densification of at least about 70% and preferably of at least about 80%.

Moreover, the chemical groups serving as sites of attachment on the surface of the carbon nanotubes react with she metal during this step ii), thus making it possible to obtain a good interface between the metal and the carbon nanotubes.

Step iii)

Following step ii), a solid element is introduced into a metal tube according to step iii), this solid element being obtained directly or indirectly from the solid mass from step ii).

According to a first so-called "direct" variant, the solid element from step iii) is the solid mass as obtained in step ii).

According to a second so-called "indirect" variant, the solid element from step iii) is obtained according to at least one intermediate step between step ii) and step iii).

In a first embodiment of the second variant, the solid element from step iii) comprises granules.

According to this first embodiment, the method according to the invention preferably comprises, between step ii) and step iii), the following step:

ii-1) transforming the solid mass from step ii) into granules.

Step ii-1) of the method according to the invention can be carried out by grinding, using apparatus such as a ball mill, hammer mill, mill with millstones, mill with knives, a gas jet mill or using any other system for grinding that is able to transform the solid mass from step ii) into granules.

This step of transformation ii-1) makes it possible to obtain a homogeneous distribution of the functionalized carbon nanotubes in the composite mixture following the steps of mixing i) and of formation of a solid mass ii).

In a particular embodiment, the granules have an average size that can range from about 1 to 200 μm, and preferably from about 1 to 50 μm. This makes it possible to facilitate flow of the granules in the metal tube and deformation of said metal tube containing said granules during the next steps iii) and iv).

In fact, if the granules are too small, i.e. smaller than 1 μm, they clog the tooling with which they are in contact. When, in contrast, the granules are too large, i.e. larger than 200 μm, the stresses to which said granules are subjected during step iv) of deformation of the metal tube are difficult to control and risk being too large and consequently leading to degradation of the carbon nanotubes/metal interfaces.

In a second embodiment of the second variant, the solid element from step iii) is a solid mass different from the solid mass from step ii).

According to this second embodiment, the method according to the invention preferably comprises, between step ii-1) and step iii), the following step:

ii-2) forming a solid mass from the granules from step ii-1).

This step ii-2) makes it possible to obtain a solid mass, notably of the monobloc type such as for example a massive bar.

It can be carried out by compacting the granules from step ii-1).

Compacting is preferably carried out using a hydraulic press or an isostatic press, cold or hot. Said compacting is preferably carried out using a hydraulic press and/or is carried out cold, to allow easier handling of the composite mixture.

The solid mass thus formed according to this step ii-2) can be introduced more easily and more quickly than the granules into the metal tube in the next step iii).

The solid mass from step ii) or step ii-2), or the granules from step ii-1) are then introduced into a metal tube according to step iii) of the method according to the invention.

In a particular embodiment, the metal tube in step iii) is a tube of a metal selected from copper, aluminum, silver, a copper alloy, an aluminum alloy, a silver alloy and a mixture thereof.

Step iv)

Step iv) of deformation of the metal tube from step iii) makes it possible to deform said metal tube, and thus obtain a metal tube with the desired dimensions and shape.

In a particular embodiment, step iv) is carried out by spinning and/or by drawing and/or by rolling and/or by hammering.

These various steps of deformation and/or of shaping can be carried out using means well known by a person skilled in the art.

During this step iv), the solid element from step iii) moves and becomes oriented in the metal tube so as to minimize its deformation and thus the stresses to which it is subjected.

When said solid element from step iii) can no longer move in the metal tube following the deformation step iv), and the tube does not yet have the desired shape and dimensions, the method according to the invention can further comprise, subsequent to step iv), the following steps:

v) heating said metal tube as deformed at the end of step iv), and vi) deforming said metal tube from step v).

Step v)

Step v) of heating the metal tube makes it possible to expand the outer envelope of said metal tube so as to create space so that the granules or the solid mass can move again stress-free during a subsequent deformation step.

In a particular embodiment, heating according to step v) can be carried out at a temperature in the range from about 200 to 500° C., and preferably from about 200 to 300° C., optionally under a neutral or reducing atmosphere, notably using an electric furnace, an induction furnace or a gas-fired furnace. In this temperature range, the carbon nanotubes as well as the carbon nanotubes/metal interfaces are subject to little if any stress. Accordingly, said carbon nanotubes/metal interfaces and the functionalization of the carbon nanotubes are preserved during said step v).

Step vi)

Following step v) for creating more space in the metal tube, the method further comprises step vi) of deformation of said metal tube. Step vi) of deformation of the metal tube makes it possible to deform said metal tube, and thus obtain a metal tube with the desired dimensions and shape.

In a particular embodiment, step vi) is carried out by spinning and/or by drawing and/or by rolling and/or by hammering.

These various steps of deformation and/or of shaping can be carried out using means well, known by a person skilled in the art.

During this step vi), the solid element from step iii) moves and becomes oriented in the metal tube so as to minimize its deformation and thus the stresses to which it is subjected.

In a particular embodiment, steps v) and vi) are carried out as many times as necessary to obtain the metal tube with the desired final dimensions and shape.

In a particular embodiment, the method according to the invention can further comprise, after carrying out the deformation step iv), or vi) if it exists, the following step:

vii) heating said deformed metal tube from step iv), or vi) if it exists.

Step vii)

The heating of the metal tube can be carried out by conventional sintering, flash sintering or by melting. It makes it possible to redensify the solid element from step iii), and thus obtain and/or maintain a good interface between the metal and the carbon nanotubes.

In a preferred embodiment, step vii) is carried out by flash sintering.

The final step of heating vii) of the deformed metal tube from step iv) or vi) makes it possible to "reactivate" the carbon nanotubes/metal interfaces if they were slightly degraded during steps iv), and v) and vi) if they exist.

Thus, with the method of the invention, the carbon nanotubes/metal interfaces are subjected to little if any mechanical stress and they are preserved throughout the method. This method thus makes it possible to obtain an elongated electrically conducting element, possessing good electrical properties, notably in terms of conductivity, and good mechanical properties.

The present invention also relates to an elongated electrically conducting element obtained by the method as defined in the present invention.

The applicant discovered that the method according to the invention makes it possible to obtain an elongated electrically conducting element possessing mechanical strength 2 to 3 times greater than that obtained with an elongated electrically conducting element formed solely of a metal such as copper, aluminum, silver or an alloy thereof, and with electrical conductivity increased by about 20% relative to the latter.

The present invention also relates to an electric cable comprising an elongated electrically conducting element obtained by the method as defined in the present invention.

Said cable has improved mechanical and electrical properties.

More particularly, the electric cable according to the invention can be an electric cable of the power cable type. In this case, the elongated electrically conducting element of the invention is surrounded by a first semiconducting layer, the first semiconducting layer being surrounded by an electrically insulating layer, and the electrically insulating layer being surrounded by a second semiconducting layer.

In a particular embodiment, generally conforming to the electric cable of the power cable type of the invention, the first semiconducting layer, the electrically insulating layer and the second semiconducting layer constitute a three-layer insulation. In other words, the electrically insulating layer is directly in physical contact with the first semiconducting layer, and the second semiconducting layer is directly in physical contact with the electrically insulating layer.

The electric cable of the invention can further comprise a metal screen surrounding the second semiconducting layer.

This metal screen can be a so-called "wire" screen composed of a set of conductors made of copper or aluminum arranged around and along the second semiconducting layer, a so-called "taped" screen composed of one or more conductive metal tapes coiled around the second semiconducting layer, or a so-called "impervious" screen of the metal tube type surrounding the second semiconducting layer. The latter type of screen can notably provide a barrier to moisture, which has a tendency to penetrate the electric cable in the radial direction.

All the types of metal screens can perform the role of earthing of the electric cable and can thus transport currents by default, for example in the case of a short-circuit in the network in question.

Moreover, the cable of the invention can comprise an outer protective sheath surrounding the second semiconducting layer, or else more particularly surrounding said metal screen if present. This outer protective sheath can be produced conventionally starting from suitable thermoplastics such as HDPE, MDPE or LLDPE; or else from materials retarding flame propagation or resistant to flame propagation. Notably, if the latter do not contain halogen, they are called sheathing of the HFFR (Halogen Free Flame Retardant) type.

Other layers, such as layers that swell in the presence of moisture, can be added between the second semiconducting layer and the metal screen when it is present and/or between the metal screen and the outer sheath when they are present, these layers providing longitudinal hermeticity of the electric cable to water.

The invention claimed is:

1. Method of manufacturing an elongated electrically conducting element having functionalized carbon nanotubes and at least one metal, comprising the following steps:

i) mixing functionalized carbon nanotubes with at least one metal, to obtain a composite mixture;

ii) forming a solid mass from the composite mixture from step i);

iii) inserting a solid element obtained from the solid mass from step ii) into a metal tube; and iv) deforming said metal tube from step iii), to obtain an elongated electrically conducting element.

2. Method according to claim 1, wherein said method further comprises, prior to step i), the following step:

a) functionalizing carbon nanotubes.

3. Method according to claim 1, wherein the amount of functionalized carbon nanotubes in the composite mixture, in step i), is in the range from 0.3 to 15 wt %.

4. Method according to claim 1, wherein the metal used in step i) is selected from the group consisting of copper, aluminum, silver, a copper alloy, an aluminum alloy, a silver alloy and a mixture thereof.

5. Method according to claim 1, wherein step ii) is carried out by flash sintering.

6. Method according to claim 5, wherein flash sintering is carried out at a pressure in the range from 10 to 100 bar.

7. Method according to claim 5, wherein flash sintering is carried out at a temperature in the range from 400 to 900° C.

8. Method according to claim 1, wherein said method comprises, between step ii) and step iii), the following step:

ii-1) transforming the solid mass from step ii) into granules.

9. Method according to claim 8, wherein step ii-1) makes it possible to obtain granules having a size from 1 to 50 μm.

10. Method according to claim 8, wherein said method comprises, between step ii-1) and step iii), the following step:

ii-2) forming a solid mass from the granules from step ii-1).

11. Method according to claim 1, wherein the metal tube is a tube of a metal selected from the group consisting of copper, aluminum, silver, a copper alloy, an aluminum alloy, a silver alloy and a mixture thereof.

12. Method according to claim 1, wherein said method further comprises, subsequent to step iv), the following steps:

v) heating said metal tube as deformed at the end of step iv), and vi) deforming said metal tube from step v).

13. Method according to claim 12, wherein the heating according to step v) is carried out at a temperature in the range from 200 to 500° C.

14. Method according to claim 1, wherein said method further comprises the following step:

vii) heating the deformed metal tube.

15. Method according to claim 14, wherein step vii) is carried out by flash sintering.

* * * * *